US005277643A

United States Patent [19]

Ejima

[11] Patent Number: 5,277,643

[45] Date of Patent: Jan. 11, 1994

[54] CONNECTABLE TOY

[75] Inventor: Takio Ejima, Sakura, Japan

[73] Assignee: Takara Co., Ltd., Japan

[21] Appl. No.: 932,262

[22] Filed: Aug. 19, 1992

[30] Foreign Application Priority Data

Jul. 6, 1992 [JP] Japan ..... 4-202043

[51] Int. Cl.[5] ..... A63H 17/00; A63H 33/04; A63H 33/26

[52] U.S. Cl. ..... 446/93; 446/91; 446/139; 446/485

[58] Field of Search ..... 446/91, 92, 93, 94, 446/95, 99, 100, 101, 137, 138, 139, 484, 485, 487, 456

[56] References Cited

U.S. PATENT DOCUMENTS

| | | | |
|---|---|---|---|
| 2,310,037 | 2/1943 | Reno | 446/485 X |
| 3,068,615 | 12/1962 | Nassour | 446/139 |
| 3,961,440 | 6/1976 | Saito | 446/99 X |
| 4,118,888 | 10/1978 | Ogawa | 446/92 |
| 4,183,173 | 1/1980 | Ogawa | 446/92 X |
| 4,712,184 | 12/1987 | Haugerud | 446/95 X |
| 4,723,931 | 2/1988 | Allen et al. | 446/97 X |
| 4,741,717 | 5/1988 | Wolf | 446/484 X |
| 4,869,701 | 9/1989 | Kawai et al. | 446/91 |
| 4,878,873 | 11/1989 | Yamaguchi et al. | 446/485 X |
| 5,114,376 | 5/1992 | Copley et al. | 446/485 X |

FOREIGN PATENT DOCUMENTS

| | | | |
|---|---|---|---|
| 613379 | 5/1935 | Fed. Rep. of Germany | 446/91 |
| 2185897 | 8/1987 | United Kingdom | 446/485 |

*Primary Examiner*—David N. Muir
*Attorney, Agent, or Firm*—Price, Gess & Ubell

[57] ABSTRACT

A connectable toy capable of permitting a user to enjoy play full of unexpectedness and novelty. The connectable toy includes a toy body and attachments constructed so as to be detachably connectable to the toy body. The connectable toy further includes a circuit consisting of a circuit portion arranged in the toy body and a circuit portion arranged in each of the attachments. Connection and disconnection of the circuit is carried out through coupling sections of the toy body and the attachments.

19 Claims, 7 Drawing Sheets

CONNECTABLE TOY

BACKGROUND OF THE INVENTION

This invention relates to a connectable toy, and more particularly to a connectable toy including a toy body and at least one attachment detachably connected to the toy body, each of which has a part of an electrical circuit incorporated therein.

In a conventional connectable toy which is constructed by connecting a plurality of joined members to each other through a coupling means, the joined members are formed into different shapes to permit a user to enjoy play. However, the conventional connectable toy is merely constructed so that the joined members are joined to each other, resulting in the play lacking unexpectedness and novelty, to thereby fail to provide a user with interest and pleasure. Thus, a user of the conventional connectable toy is limited to children.

SUMMARY OF THE INVENTION

The present invention has been made in view of the foregoing disadvantage of the prior art.

Accordingly, it is an object of the present invention to provide a connectable toy which is capable of permitting a user to enjoy play full of unexpectedness and novelty.

It is another object of the present invention to provide a connectable toy which is capable of permitting a user to develop play in a wide range.

It is a further object of the present invention to provide a connectable toy which is capable of facilitating the assembling, resulting in a user readily carrying out operation of the toy.

It is still another object of the present invention to provide a connectable toy which is capable of simplifying the structure.

In accordance with the present invention, a connectable toy is provided. The connectable toy includes a toy body, at least one attachment detachably connectable to the toy body through a coupling means defined between the toy body and the attachment, and a circuit comprising a circuit portion arranged in the toy body and a circuit portion arranged in the attachment. The circuit portions of the circuit are connected to and disconnected from each other at the coupling means.

In a preferred embodiment of the present invention, the coupling means is constructed so as to magnetically join the toy body and attachment to each other.

In a preferred embodiment of the present invention, the coupling means includes a contact means for electrically connecting the circuit portions to each other therethrough.

In a preferred embodiment of the present invention, the coupling means comprises at least one coupling section provided on the side of the toy body and at least one coupling section provided on the side of the attachment.

In a preferred embodiment of the present invention, the toy body and attachment each are formed in imitation of an actual thing.

In a preferred embodiment of the present invention, the attachment may include a drive means connected to the circuit to drive the attachment.

In a preferred embodiment of the present invention, the attachment may include a light-emitter actuated through the circuit.

In a preferred embodiment of the present invention, the attachment may include a light source connected to the circuit to illuminate the toy body. The attachment may further include a sound producing unit connected to the circuit.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Figure 1A:
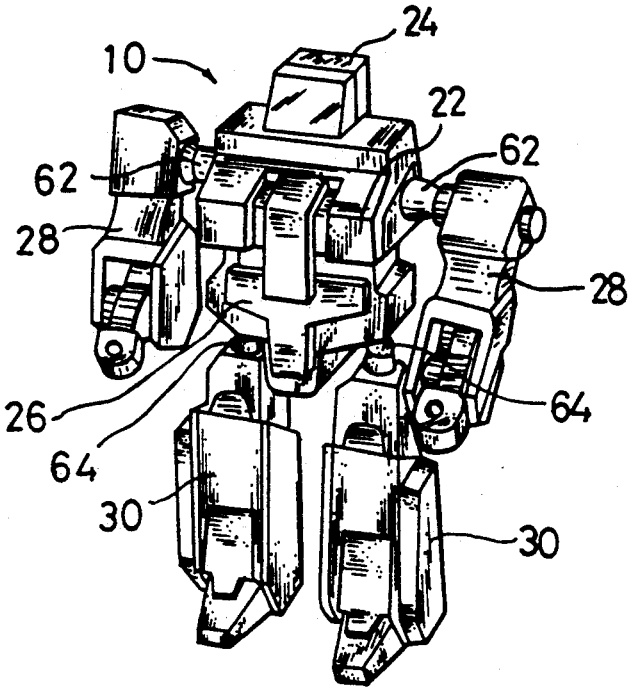
FIG. 1A is a front perspective view generally showing a toy body in an embodiment of a connectable toy according to the present invention.
Figure 1B:
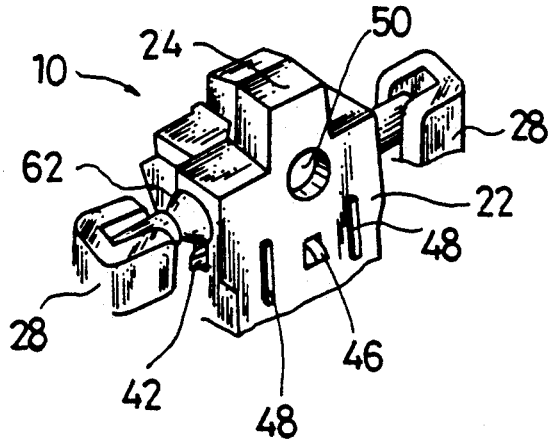
FIG. 1B is a fragmentary rear perspective view of an upper portion of the toy body shown in FIG. 1A.

Now, a connectable toy according to the present invention will be described hereinafter with reference to the accompanying drawings.

FIGS. 1A to 7B illustrate an embodiment of a connectable toy according to the present invention. A connectable toy of the illustrated embodiment generally includes a toy body 10 shown in FIG. 1A and 1B, and attachments detachably selectively joined to the toy body 10 as desired which are designated at reference numerals 12, 14, 16, 18 and 20 in FIGS. 3A and 3B, 4A and 4B, 5A and 5B, 6A and 6B, and 7A and 7B, respectively. The attachments each may be formed in imitation of an actual thing.

The toy body 10 may be formed into any desired shape in imitation of an actual thing. In the illustrated embodiment, the toy body 10 is formed in imitation of a robot and includes a trunk 22, and a head 24 and a waist 26 each integrally mounted on the trunk 22. The toy body 10 also includes a pair of arms 28 detachably connected to both sides of the trunk 22 and a pair of legs 30 detachably connected to both sides of a lower portion of the waist 26.

Figure 2:
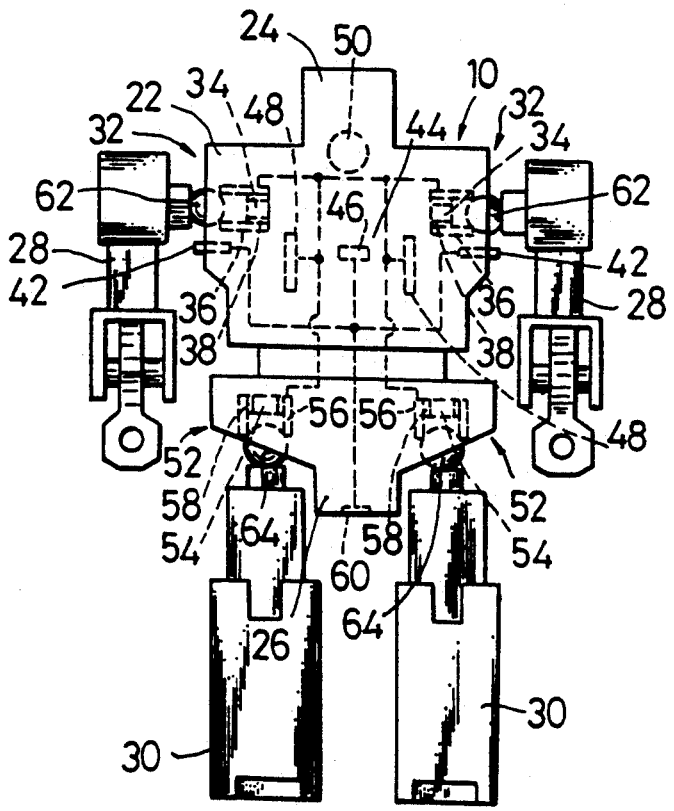
FIG. 2 is a schematic front elevation view of the toy body shown in FIG. 1A.
Figure 8:
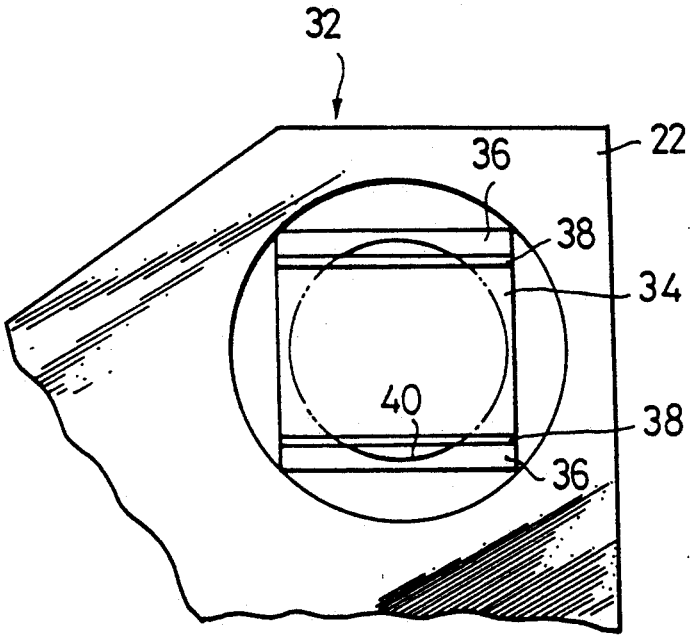
FIG. 8 is a fragmentary side elevation view showing the manner of connection between a first coupling section of a trunk and each of arms.
Figure 10:
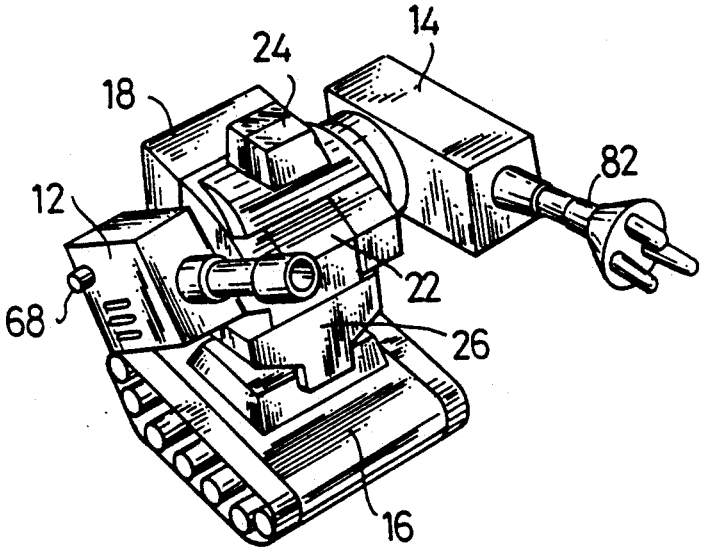
FIG. 10 is a perspective view showing another example of a connectable toy of the present invention which comprises a combination of a toy body and attachments joined thereto.

The trunk 22 is provided at an upper portion of each of both sides thereof with a first coupling section 32 which constitutes a part of a coupling means and through which the arm 28 is connected to the trunk 22, as shown in FIG. 2. The first coupling sections 32 each include a magnet 34 arranged in a recess formed in the trunk 22 and a pair of conductive iron elements 36 magnetically securely fixed on upper and lower surfaces of the magnet 34 through thin insulating members 38, respectively. The conductive iron elements 36 each are arranged in a manner to extend in a lateral direction of the trunk 22 and be exposed at an outer distal end thereof. The conductive iron elements 36 are magnetized by the magnet 34, resulting in providing a pair of magnetic poles. Also, the conductive iron elements 36 are provided at the outer distal end thereof with a hemispherical recess 40 in a manner to extend therebetween as shown in FIG. 8, resulting in acting also as an electrical contact for a conductive hemispherical member provided in the attachment 12, which will be described hereinafter.

The trunk 22 is also provided on both sides thereof with a pair of contacts 42, each of which is made of a conductive material and positioned in proximity to a lower portion of the coupling section 32. The contacts 42 each are arranged in such a manner that a distal end thereof is outward projected from the trunk 22. The trunk is also provided on a central portion of a rear surface thereof with a second coupling section 44 constituting another part of the coupling means. The second coupling section 44 includes a contact 46 made of a conductive material and arranged so as to rearward project from the trunk 22 and a pair of elongated contacts 48 arranged so as to interpose the contact 46 therebetween and extend in a vertical direction of the trunk 22. The contacts 48 each are made of a magnetic conductive material. A boundary between the trunk 22 and the head 24 is formed at a central portion of a rear surface thereof with a recess 50 for housing a light source which will be described hereinafter. The head 24 has a front surface formed of a light-permeable material.

The waist 26 which is formed integral with the trunk 22 is provided therein with coupling sections 52 in a manner to be in proximity to both sides of the waist 26, which constitutes another part of the coupling section for detachably connecting the legs 30 to the waist 26 therethrough. The coupling sections 52 each include a magnet 54 and a pair of conductive iron elements 56 magnetically securely fixed on both sides of the magnet 54 through a pair of thin insulating members 58. The iron elements 56 each are so arranged that a distal end thereof downward extends and is exposed. The iron elements 56 thus constructed act also as a contact. The waist 26 is also provided at a central portion of a lower surface thereof with a contact 60, which is arranged so as to be exposed.

The conductive iron elements 36 and contacts 48 of the first coupling sections 32 of the trunk 22 and the conductive iron elements 56 of the coupling sections 52 of the waist 26 are electrically connected to each other and the contacts 42, 46 and 60 are electrically connected to each other.

The arms 28 each are provided on an inner side of a proximal portion thereof with a coupling section 62, which includes a spherical member 62 made of a magnetic material. The coupling section 62 is constructed in a manner to correspond to the first coupling section 32 of the trunk 22 so as to be detachably magnetically joined to thereto. The legs 30 each are provided at a proximal portion thereof with a coupling section 64, which comprises a spherical member 64 made of a magnetic material. The coupling section 64 is constructed in a manner to correspond to the first coupling section 32 of the trunk 22 so as to be detachably magnetically joined to thereto.

Figure 3A:
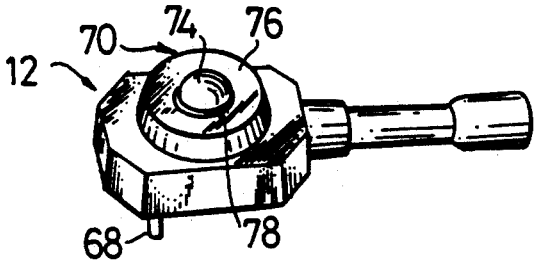
FIG. 3A is a perspective view showing an attachment formed in imitation of a ray shooter which is adapted to be detachably connected to the toy body shown in FIG. 1A.
Figure 3B:
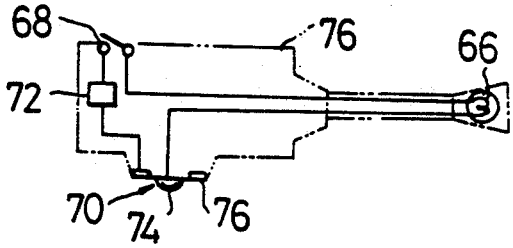
FIG. 3B is a schematic view showing an internal structure of the attachment shown in FIG. 3A.

The first attachment 12, as shown in FIGS. 3A and 3B, is formed in imitation of a ray shooter and adapted to be detachably joined to the trunk 12 in place of the arm 28. The first attachment 12 includes a light-emitter 66 provided therein in a manner to be in proximity to a distal end thereof. Also, the first attachment 12 is provided on an outer side of a proximal portion thereof with a switch 68 and on an inner side thereof with a coupling section 70 constituting another part of the coupling means. Further, the first attachment 12 includes a sound producing unit 72 provided therein and comprising a sound synthesizing IC. The coupling section 70 includes a hemispherical member 74 made of a magnetic and conductive material and an annular member 76 made of a conductive material and arranged around the hemispherical member 74 through an insulating member 78. The light-emitter 66, switch 68, hemispherical member 74 and annular member 76 are electrically connected to each other. The coupling section 70 of the first attachment 12 acts also as a contact. Also, the hemispherical member 74 and annular member 76 are constructed so as to be joined to the iron elements 56 of the first coupling section of the trunk 22 and the contact 42 of trunk 12, respectively, when the first attachment 12 is magnetically joined to the first coupling section 32 of the trunk 22 in place of the arm 28.

Figure 4A:
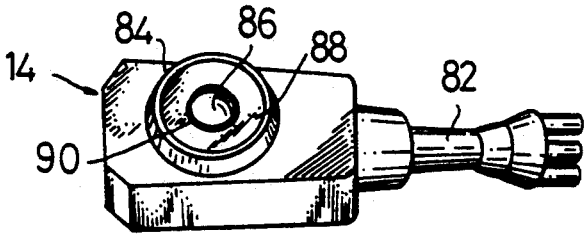
FIG. 4A is a perspective view showing another attachment formed in imitation of a drilling machine which is adapted to be detachably connected to the toy body shown in FIG. 1A.
Figure 4B:
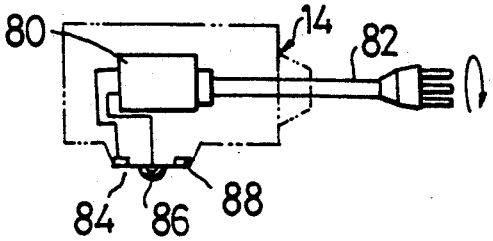
FIG. 4B is a schematic view showing an internal structure of the attachment shown in FIG. 4A.

The second attachment 14, as shown in FIGS. 4A and 4B, is formed in imitation of a drilling machine and adapted to be detachably joined to the first coupling section 32 of the trunk 12 in place of the arm 28. The second attachment 14 includes a motor 80 provided therein and a revolving rod 82 connected to the motor 80 and having a distal end formed in imitation of a drill and outward projected from the second attachment 14. The second attachment 14 also includes a coupling section 84, which is provided on an inner side of a proximal portion of the attachment 14. The coupling section 84 includes a hemispherical member 86 made of a magnetic and conductive material and an annular member 88 made of a conductive material and arranged around the hemispherical member 86 through an insulating member 90. The motor 80, hemispherical member 86 and annular member 88 are electrically connected to each other. Also, the coupling section 84 of the second attachment 14 acts also as a contact. Further, the hemispherical member 86 and annular member 88 of the coupling section 84 are detachably joined to the iron elements 36 of the first coupling of the trunk 22 and the contact 42 of the trunk 22, respectively, when the second attachment 14 is magnetically detachably joined to the first coupling section 32 of the trunk 22 in place of the arm 28. The second attachment 14 may be provided with a switch like the switch 68 of the first attachment 12.

Figure 5A:
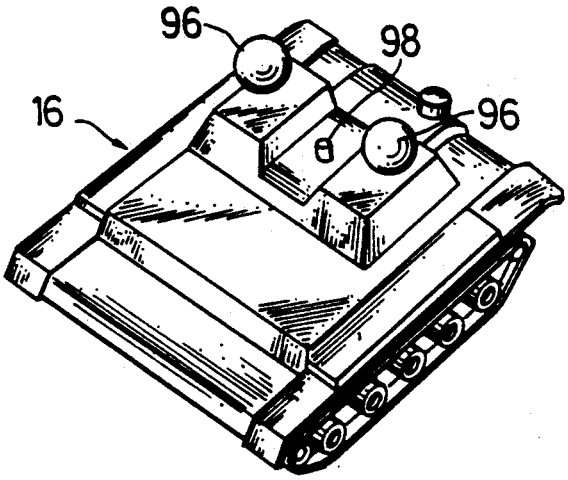
FIG. 5A is a perspective view showing another attachment formed in imitation of a combat car or tank which is adapted to be detachably connected to the toy body shown in FIG. 1A.
Figure 5B:
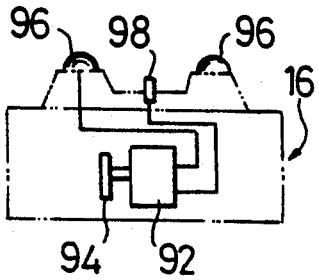
FIG. 5B is a schematic view showing an internal structure of the attachment shown in FIG. 5A.

The third attachment 16, as shown in FIGS. 5A and 5B, is formed in imitation of a tank and adapted to be substituted for the legs 30. The attachment 16 includes a motor 92 provided therein and a disc 94 eccentrically mounted on a revolving shaft of the motor 92. The attachment 16 is provided at a central portion of an upper surface thereof with a pair of coupling sections 96 constituting another part of the coupling means, which are arranged in juxtaposition to each other. The coupling sections 96 each comprise a spherical member made of a magnetic and conductive material. Between the spherical members is arranged a contact 98 in a manner to be upward projected from the attachment 16. The motor 92, coupling sections 96 and contact 98 are electrically connected to each other. Further, the coupling sections 96 act also as a contact. Thus, the coupling section 96 and contact 98 of the attachment 16 are joined to the iron elements 56 of the coupling section 52 of the waist 26 and the contact 60 of the waist 26, respectively, when the attachment 16 is magnetically detachably connected to the waist 26 in place of the legs 30.

Figure 6A:
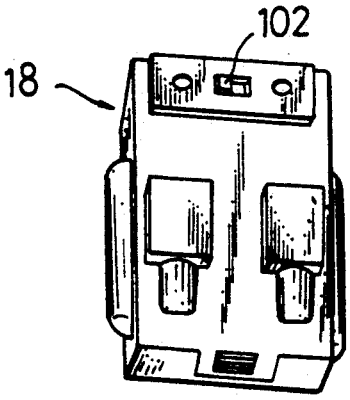
FIG. 6A is a perspective view showing a further attachment formed in imitation of a transmitter which is adapted to be detachably connected to the toy body shown in FIG. 1A.
Figure 6B:
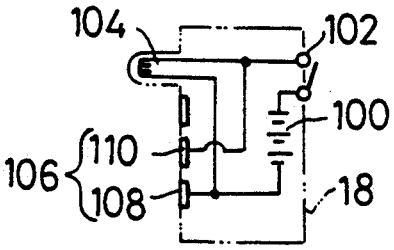
FIG. 6B is a schematic view showing an internal structure of the attachment shown in FIG. 6A.

The fourth attachment 18, as shown in FIGS. 6A and 6B, is formed in imitation of a transmitter and adapted to be detachably joined to the second coupling section 44 of the trunk 22 as desired. The attachment 18 is provided therein with a battery means 100 for a power supply and at a central portion of an upper surface thereof with a switch 102. Also, the attachment 18 includes a light source 104 arranged at a central portion of a rear surface thereof in a manner to be projected therefrom. Further, the attachment 18 includes a coupling section 106 arranged below the light source 104 and including a negative contact 108 and a positive contact 110. The negative contact 108 is arranged so as to rectangularly surround the positive contact 110. In the fourth attachment 18 thus constructed, the battery means 100, switch 102, light source 104 and contacts 108 and 110 are electrically connected to each other as shown in FIG. 6B. Also, the light source 104 is received in the recess 50 of the trunk 22 and the contacts 108 and 110 are associated with the contacts 48 and 46, respectively, when the attachment 18 is magnetically joined to the second coupling section 44 of the trunk 22.

Figure 7A:
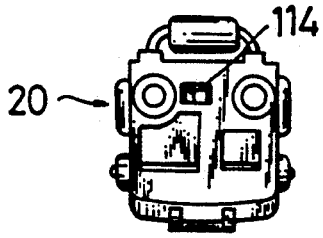
FIG. 7A is a perspective view showing still another attachment formed in imitation of another transmitter which is adapted to be attached to the toy body shown in FIG. 1A.
Figure 7B:
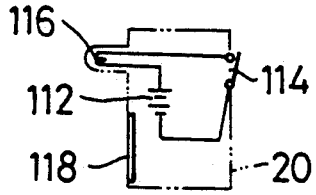
FIG. 7B is a schematic view showing an internal structure of the attachment shown in FIG. 7A.

The fifth attachment 20, as shown in FIGS. 7A and 7B, is formed in imitation of another transmitter and adapted to be detachably joined to the second coupling section 44 in place of the attachment 18 as desired. The attachment 20 includes a battery means 112 for a power supply which is arranged therein. The attachment 20 is also provided at a central portion of a front surface thereof with a switch 114 and at a central portion of a rear surface thereof with a light source 116. Further, the attachment 20 is provided at a lower portion of the rear surface thereof with a magnetic member 118. The battery means 112, switch 114 and light source 116 are electrically connected to each other. The light source 116 is received in the recess 50 of the trunk 22 and the magnetic member 118 is magnetically attracted by the contacts 48 made of a magnetic and conductive material, when the attachment 20 is magnetically detachably joined to the second coupling section 44 of the trunk 22.

Now, an example of the manner of operation of the connectable toy of the illustrated embodiment constructed as described above will be described with reference to FIG. 9.

Figure 9:
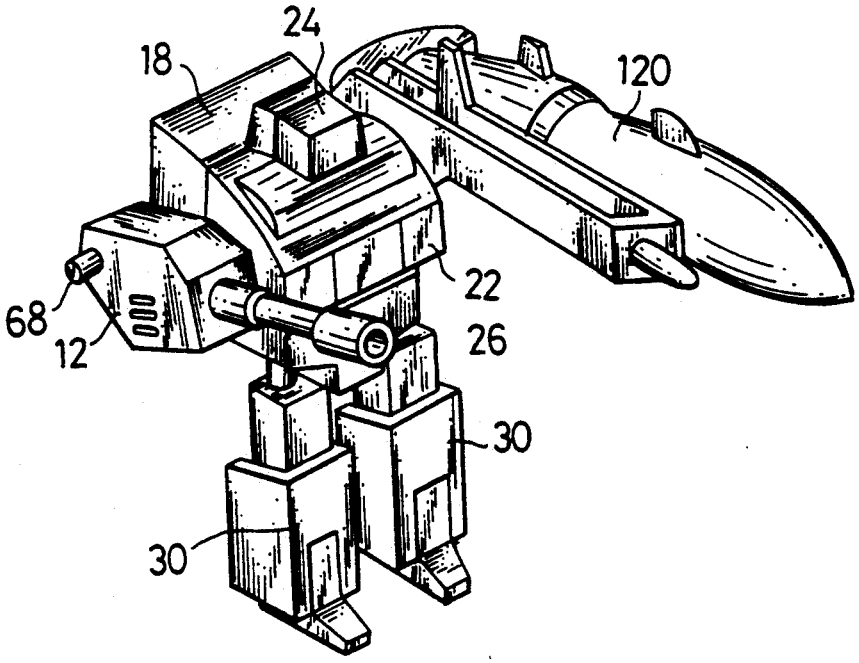
FIG. 9 is a perspective view showing an example of a connectable toy of the present invention which comprises a combination of a toy body and attachments joined thereto.

First, the arms 28 are disconnected from the first coupling sections 32 of the trunk 22 and then the first attachment 12 in imitation of a ray shooter is magnetically joined to one of the first coupling section 32 and a sixth attachment 120 formed in imitation of a rocket launcher is magnetically joined to the other coupling section 32. The attachment 120 may be constructed in substantially the same manner as the first attachment 30 or second attachment 40 except a configuration thereof. Also, the fourth attachment 18 in imitation of a transmitter is magnetically joined to the second coupling section 44 on the rear surface of the trunk 22. This results in a connectable toy being assembled as shown in FIG. 9 and the electrical circuits provided in the toy body 10 and attachments 12 and 18 being connected to each other.

Then, turning-on of the switch 102 of the fourth attachment 18 permits the light source 104 to emit light, resulting in the head 24 of the toy body 10 being illuminated. Concurrently or subsequently, turning-on of the switch 68 permits the light-emitter 66 to emit light and simultaneously the sound producing unit 72 to produce a predetermined sound. Thus, a user is impressed since it appears as if the connectable toy operates as a ray shooter.

Another example of the manner of operation of the connectable toy of the illustrated embodiment will be described with reference to FIGS. 4A and 4B, 5A and 5B, and 10.

First, the sixth attachment 120 is detached from the first coupling section 32 of the trunk 22 and then the second attachment 14 is magnetically joined to the coupling section 32. Subsequently, the legs 30 are released from the coupling sections 52 of the waist 26 and then the third attachment 16 in imitation of a tank is magnetically coupled to the coupling sections 52 therefor. Then, turning-on of the switch 102 of the fourth attachment 18 permits the motor 80 of the attachment 16 to be driven to rotate the revolving shaft 82. Likewise, the motor 92 of the attachment 16 is driven to lead to rotation of the disc 94 eccentrically mounted on the motor 92, resulting in vibration occurring to operate the whole connectable toy.

Further, it is possible that the fifth attachment 20 is substituted for the fourth attachment 18, wherein turning-on of the switch 114 of the attachment 20 permits the light source 116 to emit light, resulting in illuminating only the head 24.

Thus, it will be noted that the connectable toy of the present invention permits a user to enjoy play full of unexpectedness and novelty and substantially develop the play. Also, in the present invention, joining of the attachments to the toy body is facilitated because of using magnetic force, so that a user may readily carry out operation of the connectable toy and the structure of the toy may be simplified.

While a preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

I claim:

1. A connectable toy comprising:

a toy body;

at least one attachment detachably connectable to said toy body through a first coupling means and a second coupling means defined between said toy body and said attachment; and a circuit comprising a first circuit portion arranged in said toy body and a second circuit portion arranged in said attachment;

said first and second circuit portions of said circuit being connected to and disconnected from each other at said first and second coupling means, said first coupling means on one of said body and attachment including an electrically conductive means which also providing a magnetic force and a metallic coupling section on the other of said body and attachment for magnetically adhering to the electrically conductive means, the second coupling means including a first contact member on the attachment and a second contact member on the toy body, whereby connection of the attachment to the toy body will interconnect the first and second coupling means to complete the circuit.

2. A connectable toy as defined in claim 1, wherein said coupling means comprises at least one coupling section provided on the side of said toy body and at least one coupling section provided on the side of said attachment.

3. A connectable toy as defined in claim 1, wherein said toy body and attachment each are formed in imitation of an actual thing.

4. A connectable toy as defined in claim 1, wherein said attachment includes a drive means connected to said circuit to drive said attachment.

5. A connectable toy as defined in claim 1, wherein said attachment includes a light-emitter actuated through said circuit.

6. A connectable toy as defined in claim 1, wherein said attachment includes a light source connected to said circuit to illuminate said toy body.

7. A connectable toy as defined in claim 6, wherein said attachment further includes a sound producing unit connected to said circuit.

8. A connectable toy comprising:

a toy body;

at least one attachment detachably connectable to said body;

a circuit comprising a first circuit portion arranged in said toy body and a second circuit portion arranged in said attachment;

coupling means for coupling said attachment with said toy body, including a magnet in communication with said first circuit portion, an electrically conductive member attracted by the magnetic force of said magnet so as to join said toy body and said attachment to each other, said coupling means further comprising contact means displaced from said magnet electrically connecting said first and second circuit portions of said circuit to each other; and a working member arranged in said attachment and electrically connected to said second circuit portion;

said first and second circuit portions of said circuit being connected to and disconnected from each other at said coupling means, whereby said working member may be activated when said attachment is joined to said toy body through said coupling means so that said circuit portions are connected to each other.

9. A connectable toy as defined in claim 8 wherein the contact means includes a semispherical metallic member insulatively spaced from said contact means which has been formed as an annular contact member.

10. A connectable toy as defined in claim 8, wherein said attachment includes a drive means connected to said circuit to drive said attachment.

11. A connectable toy as defined in claim 8, wherein said attachment includes a light-emitter actuated through said circuit.

12. A connectable toy as defined in claim 8, wherein said attachment includes a light source connected to said circuit to illuminate said toy body.

13. A toy assembly comprising:

a toy body;

an attachment member for mounting on the toy body;

means for attaching the toy body and the attachment member including a magnet, a pair of conductive elements sandwiching the magnet, and a semispherical electrically conductive member, which will be attracted by the magnetic force field to adhere to the conductive elements;

a battery having a plus terminal and a minus terminal mounted in one of the toy body and attachment member;

one of the semispherical electrically conductive member and at least one of the pair of conductive elements connected to one of the battery terminals;

an electrically conductive contact member positioned adjacent to the pair of conductive elements and connected to the other terminal;

an electrically driven device mounted in one of the toy body and attachment member and activated by the battery when the attachment member and toy body are electrically connected together; and circuit means for electrically connecting the electrically driven device and the battery.

14. A toy assembly as defined in claim 13, wherein the contact member encircles the semispherical electrically conductive member.

15. A toy assembly as defined in claim 13, wherein said electrically driven device comprises at lest one of a sound-producing unit and a light-emitting unit.

16. A toy assembly as defined in claim 15, wherein said combination further permits said light-emitting unit to emit light.

17. A toy assembly as defined in claim 13, wherein said toy body and attachment member are an imitation of a robotic humanoid.

18. A toy assembly as defined in claim 17, further including a plurality of attachment members, wherein said toy body comprises a simulated humanoid trunk, and said attachment members comprise a simulated head, a pair of simulated arms, and a pair of simulated legs.

19. A robotic toy assembly, comprising:

a toy body having removable appendages simulating humanoid appendages at appointed joints of the toy body;

each appendage having a semispherical metallic, the toy body member having a magnet and a pair of conductive joint elements sandwiching the magnet at each joint, whereby the semispherical metallic member is magnetically attached to enable a pivotal movement of the appendage member relative to the body at the joint;

a removable electrically driven device having a semispherical metallic member and a spaced terminal member which is spaced from said semispherical metallic member, the toy body further having a correspondingly-spaced contact member adjacent one of said joints whereby the electrically driven device is operatively mounted on the toy body;

a first circuit means mounted in the toy body; and a second circuit means mounted on the removable electrically driven device, the first and second circuit means being electrically connected through at least two of the conductive joint elements, the semispherical metallic member, the spaced terminal member, and the spaced contact member, whereby the electrically driven device can be activated.

* * * * *